United States Patent [19]

Kariya et al.

[11] Patent Number: 4,988,047

[45] Date of Patent: Jan. 29, 1991

[54] WINDING APPARATUS

[75] Inventors: Keiichrou Kariya; Masahiro Ishida, both of Yokohama, Japan

[73] Assignee: Kabushiki Kaisha Toshiba, Kawasaki, Japan

[21] Appl. No.: 333,587

[22] Filed: Apr. 5, 1989

[30] Foreign Application Priority Data

Apr. 11, 1988 [JP] Japan ..... 63-88575

[51] Int. Cl.[5] ..... H01K 41/08

[52] U.S. Cl. ..... 242/4 R; 29/605

[58] Field of Search ..... 242/4 R, 4 C, 4 B; 29/605, 596

[56] References Cited

U.S. PATENT DOCUMENTS

| | | | |
|---|---|---|---|
| 4,625,927 | 12/1986 | Arnold | 242/4 R |
| 4,688,733 | 8/1987 | Ishida et al. | 242/4 R |
| 4,694,999 | 9/1987 | Ishida et al. | 242/4 R |

FOREIGN PATENT DOCUMENTS

| | | | |
|---|---|---|---|
| 607878 | 11/1960 | Canada | 242/4 R |
| 0108343 | 5/1984 | European Pat. Off. | 242/4 R |
| 0132843 | 2/1985 | European Pat. Off. . | |
| 59-201406 | 11/1984 | Japan . | |
| 60-186683 | 1/1985 | Japan . | |
| 61-129319 | 8/1986 | Japan . | |
| 62-47104 | 10/1987 | Japan . | |
| 667160A5 | 9/1988 | Switzerland . | |

*Primary Examiner*—Katherine Matecki

*Attorney, Agent, or Firm*—Cushman, Darby & Cushman

[57] ABSTRACT

An apparatus for winding elongated wire pieces around frame-like cores of a workpiece comprises a workpiece holder, mounted on a base so as to be movable about an axis perpendicular to an operation surface, for holding a workpiece with its frame-like cores extending therefrom, a wire piece having a first end portion fixed by the holder and a second end portion extending toward a second end face side being inserted in each core of the workpiece held by the holder, a tension means, movable in directions to move close to and away from the workpiece holder, for holding the second end portion of the wire piece, a pin fixed to the workpiece holder so as to be movable between an inoperative position at which the pin is not in contact with the wire piece and an operative position at which the pin deflects the wire piece in one direction, the operative position being defined such that contact of a wire piece portion between the workpiece holder and the tension means with the frame-like core being prevented when the workpiece holder is rotated about its rotational axis, and a guide means for guiding a wire piece portion between the tension means and the pin when the pin returns to the inoperative position after the pin is rotated together with the workpiece holder to a position at which the core is located at a position opposite to the home position.

19 Claims, 14 Drawing Sheets

WINDING APPARATUS

BACKGROUND OF THE INVENTION

1. Field of the Invention

The present invention relates to a winding apparatus for winding a wire piece having first and second end portions by at least one turn around at least one of a plurality of closed frame-like cores which are laterally formed on a workpiece with a small gap set therebetween and each of which has first and second end faces, while the wire piece is inserted in the core.

2. Description of the Related Art

A magnetic head used, e.g., in a VTR has two closed plate-like frame cores at its end portion. These cores are arranged within the same plane through a gap. Coated wires each having a diameter of, e.g., 50 μm are wound around the cores at portions adjacent to each other and portions spaced apart from each other.

In such a magnetic head, since the gap between cores is small, e.g., about 0.3 mm, and the diameter of each wire is very small, it is difficult to efficiently wind the wires around the cores at high speed.

Japanese Patent Application No. 60-186683 on Aug. 27, 1985 (Japanese Patent Disclosure (Kokai) No. 62-47104 on Feb. 28, 1987), filed by the assignee of the present application, propose an apparatus and method capable of winding wires at higher speed.

According to this method, a magnetic head is mounted on a workpiece holder which is able to rotate about a vertical axis while plate-like frame cores extend upward from the magnetic head. Thereafter, an elongated wire is supplied from a wire supply mechanism to a first end face side of the core, and a free end of the wire is drawn by a vacuum force from a second end face side by using a tension mechanism. The wire is led until a wire portion inserted in a core hole reaches a predetermined length. This wire is fixed to the workpiece holder at the first end face side, and is cut at a position nearer to the wire supply mechanism side than this fixed position. As a result, the wire piece of a desired length which has a first end portion fixed to the workpiece and a second end portion extending far from a second end face is inserted in the core hole.

When a wire piece is to be wound around the inward portion of a core, i.e., a core portion adjacent to the other core, the second end portion of the wire piece is held by the tension mechanism and is kept taut in a desired state. The workpiece holder is then rotated through 180° in the direction to bring the wire piece into contact with the inward portion of the core. In this rotation, a wire hook member mounted on the workpiece holder is moved upward so as to move a wire portion between the second face side of the core and the second end portion of the wire, and the wire piece is deflected upward. In this state, the workpiece holder is rotated while the wire is wound around the wire hook member. With this operation, contact of the wire piece with the adjacent core can be prevented.

After a wire piece portion between the wire hook member and the second end portion is disposed above the gap between the cores, the wire hook member is lowered while a wire holder is raised. As a result, the wire piece is inserted in the gap. After the wire piece is inserted in the gap between the cores, the second end portion of the wire piece is tensioned by the tension mechanism, thereby completing winding of the wire around the inward portion of the core.

When the wire piece is to be further wound, the second end portion is regripped by a wire holding member, and the second end portion is matched with the core hole by rotating the wire holding member. Thereafter, the holding member is moved toward the workpiece holder. The second end portion is then held by a second tension mechanism and is kept taut in a desired stat. After this operation, the next winding operation can be performed in the same manner as described above.

According to the above-described method, elongated wires can be efficiently wound around inward and outward portions of cores, and hence a magnetic head can be efficiently manufactured.

According to the above-described apparatus or method, however, since the gap between cores is very small, when a wire piece is inserted in the gap, the wire piece may be caught by a core. In this case, the coat of the wire may be peeled. In the worst case, the wire may be disconnected. In these cases, the magnetic core becomes a defective product.

SUMMARY OF THE INVENTION

It is an object of the present invention to provide a winding apparatus which can solve the above-described problems in the prior art and which can wind a wire around the inward portion of one core adjacent to the other core without causing the wire to be caught by the core.

In order to achieve the above object, according to the present invention, there is provided an apparatus for winding a wire piece having first and second end portions by at least one turn around at least one of a plurality of frame-like cores which are laterally formed on a workpiece with a small gap set therebetween and each of which has first and second end faces, the wire piece being inserted in the frame-like core, comprising a base having an operation surface; workpiece holding means, mounted on said base so as to be rotatable about an axis perpendicular to said operation surface, for holding the workpiece with the frame-like core extending therefrom, the wire piece having the first end portion fixed to said means on the first end face side and the second end portion extending toward the second end face being inserted in the core hold by said means; first tension means, mounted on said operation surface so as to be movable in directions to move close and away from said workpiece holding means, for holding the second end portion of the wire piece and keeping the wire piece taut; wire deflecting means which is fixed to said workpiece holding means on the second end face side of the core so as to be movable between an inoperative position at which said wire deflecting means is not brought into contact with the wire piece and an operative position at which the wire piece is deflected to one side, the operative position being defined such that contact of a portion of the wire piece between said workpiece holding means and said first tension means with the frame-like core is prevented when said workpiece holding means is reversely rotated about a rotational axis thereof; and guide means for guiding a wire piece portion between said first tension means and said wire deflecting means when said wire deflecting means returns to the inoperative position after said wire deflecting means is rotated together with said workpiece holding means to a position at which each end face of the frame-like core is reversely located.

According to this winding apparatus, the first tension means holds the second end portion of the wire piece between the cores in a desired tension state. Thereafter, the wire piece deflecting means is moved to the operative position, and the wire piece is deflected with extending to one side. When the workpiece holding means is rotated after this operation, since the wire is deflected in the above-described manner, interference between the wire piece and the cores can be prevented. When the wire piece is located at a position to match with the gap between the adjustment core, the wire piece deflecting means is returned to the inoperative state. When the wire piece is returned to the inoperative position, a portion of the wire piece approaching the gap between the adjacent cores is guided by the guide means, and hence is inserted in the gap without interfering with the cores. Therefore, the wire is inserted in the gap between the adjacent cores without being caught by the cores, and can be efficiently wound around the core while peeling of the coat and disconnection of the wire can be prevented.

It is preferable that the guide means comprises a guide plate attached to the workpiece holding means at the first end face side of the core, and being movable between the inoperative position at which the guide means and the wire piece do not interfere with each other when the workpiece holding means is rotated and the operative position at which the guide means guides the wire piece when the wire deflecting means is returned to the inoperative position. This guide plate has a guiding groove matching with the gap between the adjacent cores.

It is further preferable that the guide groove has a small-width portion continuous with an inlet portion, and a large-width portion continuous with the small-width portion from the opposite side of the inlet portion. The winding range of a core can be defined by this large-width portion.

DETAILED DESCRIPTION OF THE PREFERRED EMBODIMENTS

Figure 1:
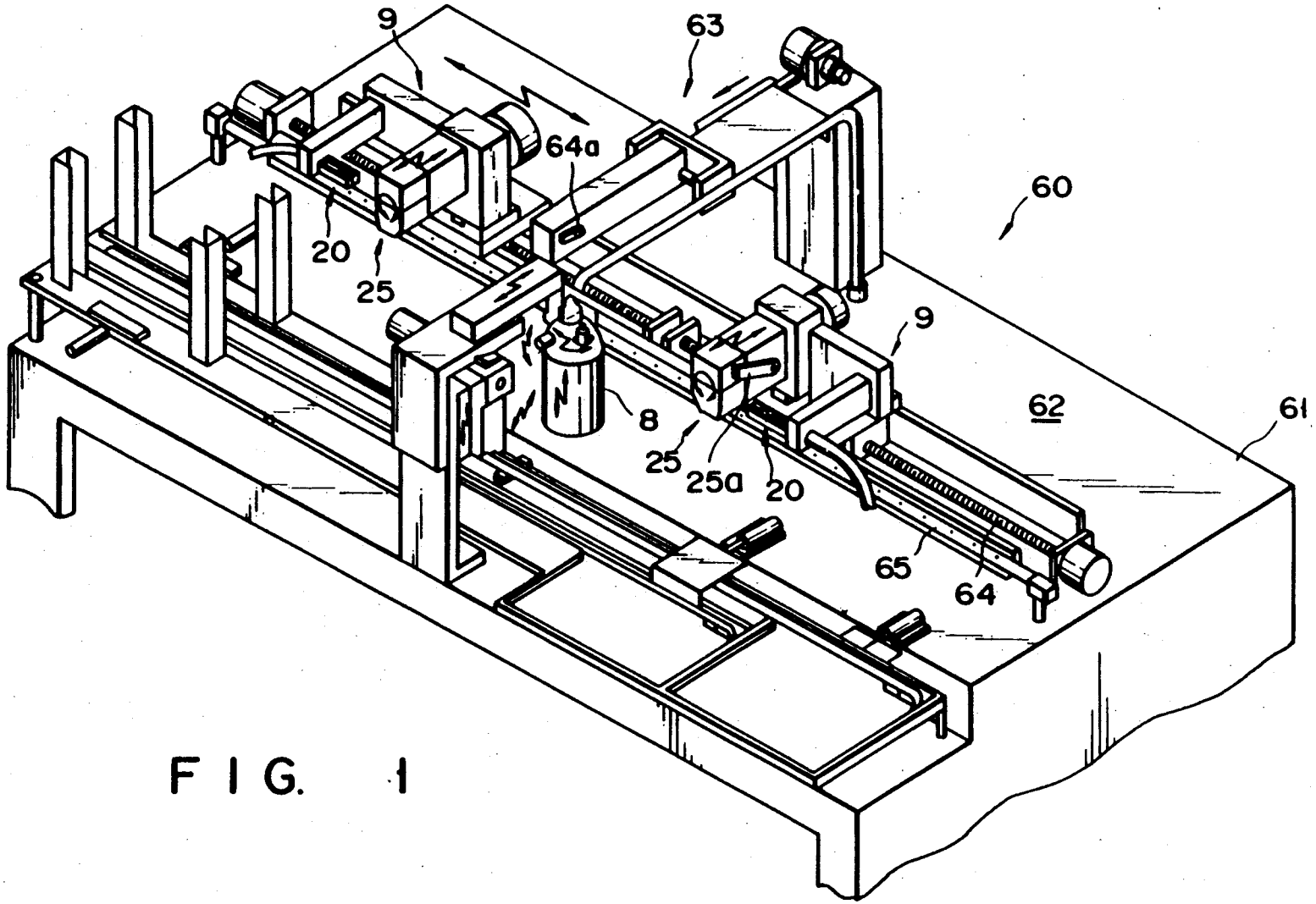
FIG. 1 is a perspective view illustrating an overall structure of a winding apparatus according to an embodiment of the present invention.
Figure 3:
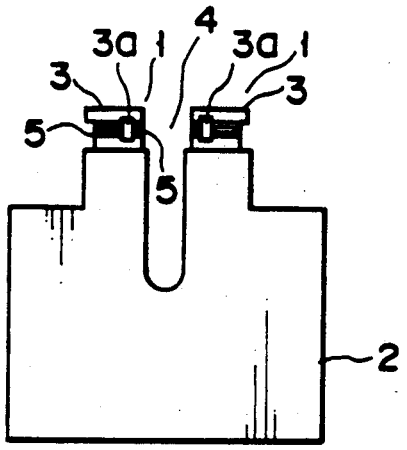
FIG. 3 is a front view illustrating a workpiece around which wires are wound by the winding apparatus in FIG. 1.

As shown in FIG. 1, a winding apparatus 60 according to an embodiment of the present invention comprises a base 61. A workpiece holder 8 for holding a magnetic head shown in FIG. 3 is rotatably mounted on a flat operation surface 62 of the base 61. A pair of wire inserting units 9 are arranged on both the sides of the workpiece holder 8 so as to oppose to each other. The wire inserting units 9 can be moved by using a proper driving mechanism, e.g., a ball screw 64*a*, in the directions to move toward and away from the workpiece holder 8. A wire supply mechanism 63 for supplying a wire having a diameter of, e.g., 50 μm to the workpiece holder 8 is arranged on the operation surface 62. The wire supply mechanism 63 comprises a proper wire source, e.g., a wire reel, and a cutter 64*a* for cutting a wire after the wire is supplied from the wire source to the workpiece holder 8 by a predetermined length. Reference numeral 65 denotes a blow pipe for blowing air supplied from an air source (not shown) to the operation surface 62 so as to prevent slackening or entanglement of the wire.

Figure 2:
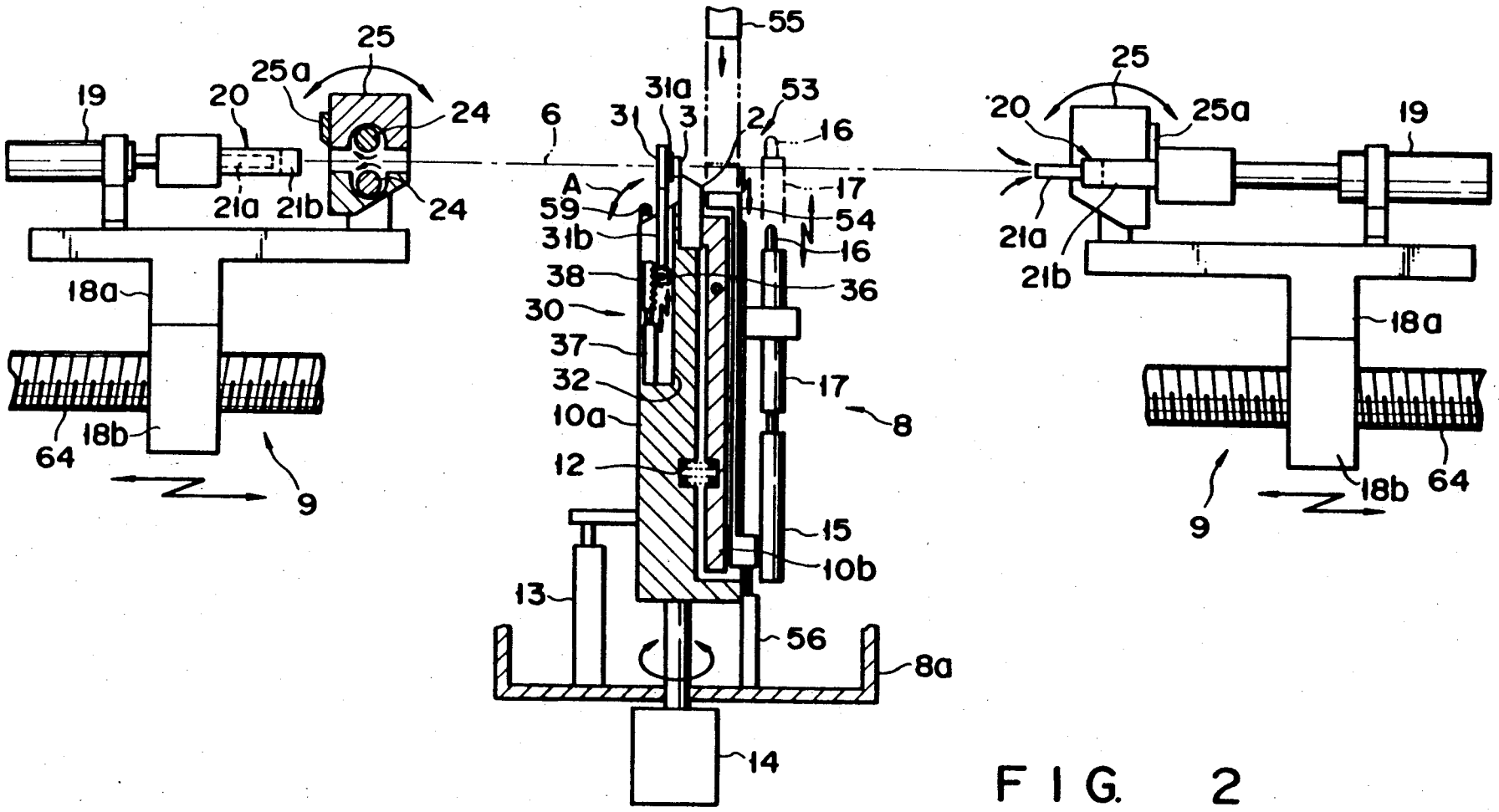
FIG. 2 is a view of an arrangement of the winding apparatus shown in FIG. 1, showing a positional relationship between a workpiece holder and a tension mechanism of the winding apparatus.

As shown in FIG. 2, each wire inserting unit 9 comprises a tension mechanism 20 for pulling an end portion of a wire and keeping the wire taut, and a wire feed mechanism 25 for clamping a wire piece kept taut by the tension mechanism 20, cutting it on the tension mechanism, and feeding it to the workpiece holder 8. The tension mechanism 20 and the wire feed mechanism 25 are mounted on a sliding block 18*a* driven by a ball screw 64*a* and a nut 18*b*. They can be, therefore moved along the ball screw 64*a*. In addition, the wire feed mechanism 25 is rotated about an axis perpendicular to the surface of the drawing, and can be disposed upside down.

Each tension mechanism 20 includes a wire suction tube 21*a* and a pair of clamp fingers 21*b* for clamping a wire. The wire suction tube 21*a* communicates with a vacuum source (not shown), and can be moved by an air cylinder 19 between a retracted position indicated on the left side of FIG. 2 and an extended position indicated on the right side thereof. When the wire suction tube 21*a* is located at the extended position, its distal end is located to match with a core hole of a magnetic head clamped by a clamp member (to be described later). Each clamp finger 21*b* includes two leaf springs opposing each other and clamp portions, each consisting of, e.g., a urethane block, respectively formed on the distal ends of the leaf springs. When the wire suction tube 21*a* is extended by the air cylinder 19, the clamp portions are opened to allow the wire suction tube 21*a* to extend (a state indicated on the right side of FIG. 2). When the tube 21*a* is retracted, the clamp portions are closed to clamp a wire (a state indicated on the left side of FIG. 2). Therefore, when the tension mechanism 20 extends the air cylinder 19 to cause the wire suction tube 21*a* to extend through the clamp fingers 21*b*, the wire can be retracted into the vacuum tube 21*a* by a vacuum force. In addition, when the tension mechanism 20 contracts the air cylinder 19 to retract the tube 21*a*, the wire can be clamped by the clamp fingers 21*b* and made taut in a desired state. In this tension state, the wire is disposed along a wire path 6 indicated by an dots and dashes line between the workpiece holder and each tension mechanism.

Each wire feed mechanism 25 comprises a pair of vertically arranged rollers 24. When the rollers 24 are driven in contact with each other, the wire clamped therebetween is fed in a desired direction. The wire feed mechanism 25 includes a cutter 25*a* for cutting a wire. The wire held by the tension mechanism 20 is clamped between the rollers 24, and cut by the cutter 25*a*. Thereafter, when the overall mechanism 25 is rotated by 180° about the axis perpendicular to the surface of FIG. 2, and the rollers 24 are rotated, the cut end of the wire is fed in the direction for a core hole.

As indicated at a central portion of FIG. 2, the workpiece holder 8 can be vertically moved by an air cylinder 13, and moreover, can be rotated about the axis perpendicular to the operation surface by, e.g., a pulse motor 14. The workpiece holder 8 includes two clamp members 10*a* and 10*b* laterally arranged and pivotally supported at an intermediate portion. A workpiece storage space is formed at upper portions of these clamp members. A magnetic head 2 shown in FIG. 3 is stored in this space while its both side surfaces respectively oppose the wire inserting units 9. Lower portions of the clamp members 10*a* and 10*b* are biased by a compression spring 12 arranged therebetween in the direction so as to be separated from each other. Therefore, the magnetic head 2 disposed in the workpiece storage space at the upper portions is firmly held in parallel with these clamp members. In this embodiment, the clamp member 10*a* is fixed to a casing 8*a*, wherein the clamp member 10*b* is formed to be movable with respect to the member 10*a*.

The magnetic head 2 which is held by these clamp members and around which a wire 5 is wound includes two magnetic cores 1 formed at one end of the main body of the head 2, as shown in FIG. 3. Each magnetic core 1 has a plate-like frame core 3 and a wire piece 5 wound around its inward and outward sides. The magnetic cores 1 are arranged in parallel within the same plane through a gap 4 of, e.g., about 0.3 mm. Reference numeral 3*a* denotes a core hole.

In addition, a wire engaging pin 17 is attached to the workpiece holder 8 on the side opposing the magnetic head 2 through the clamp member 10*b*. The pin 17 has a small-diameter engaging portion 16 as a wire deflecting means to be engaged with a wire piece. The wire engaging pin 17 is arranged at the center in the widthwise direction of the workpiece 2 (in the direction perpendicular to the surface of FIG. 2), and is vertically moved by an air cylinder 15 between an inoperative position indicated by a solid line and an operative position indicated by an phantom line. At the inoperative position at which the pin 17 is lowered, the engaging portion 16 is located below the wire path 6. At the operative position at which the pin 17 is raised, the portion 16 is engaged with the wire disposed in the wire path 6 and deflects it upward.

Furthermore, the workpiece holder 8 comprises a guide means 30 for guiding a wire.

Figure 4:
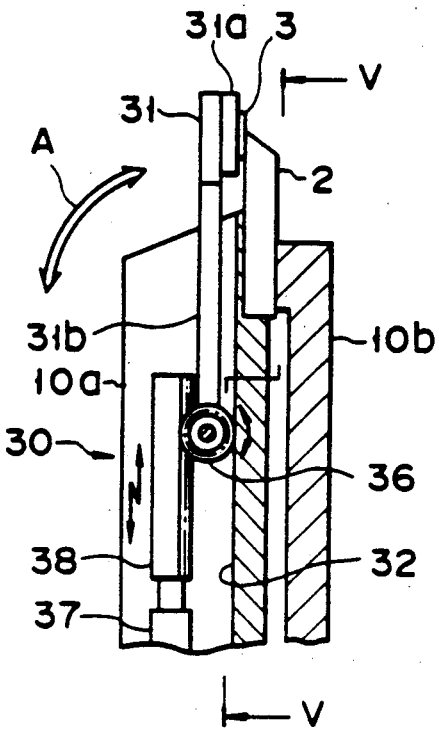
FIG. 4 is a view showing a relationship between the workpiece holder and a guide plate.
Figure 5:
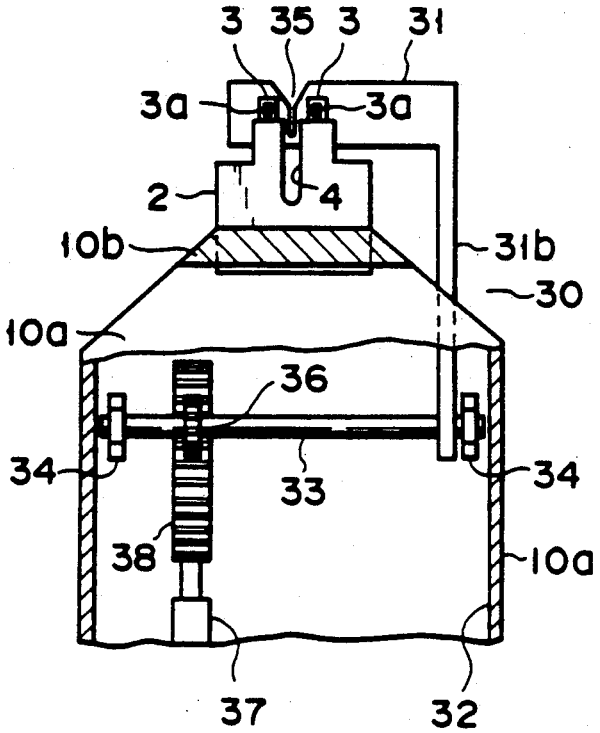
FIG. 5 is a sectional view taken along a line V—V in FIG. 4.

As shown in FIGS. 4 and 5, the guide means 30 includes a guide plate 31 pivotally supported on the stationary clamp member 10*a* on the opposite side of the wire engaging pin 17 (see FIG. 2). The guide plate 31 is constituted by an elongated plate having a size enough to completely cover the head cores 3 when the plate 31 is located at an operative position indicated in FIGS. 4 and 5.

An arm portion 31*b* extends from one side of the guide plate 31. The arm portion 31*b* is formed outside the stationary clamp member 10*a*, and is housed in a recess 32 open upward and laterally. The lower end portion of the arm portion 31*b* is fixed to a laterally extended rotary shaft 33. The rotary shaft 33 is rotatably supported by a bearing 34 fixed to the clamp member 10*a*. A pinion 36 is fixed to an intermediate portion of the rotary shaft 33. The pinion 36 is meshed with a rack 38 which is vertically moved by an air cylinder 37. With this arrangement, when the air cylinder 37 is operated, the rack 38 is moved, thereby rotating the pinion 36 meshed therewith. Upon rotation of the pinion 36, the rotary shaft 33 is rotated to rotate the arm portion 31*b* and the guide plate 31 in the direction indicated by an arrow A in FIG. 4. As shown in FIG. 4, they can be pivoted between the operative position parallel to the magnetic head 2, i.e., the cores 3 and the lower inoperative position at which no interference with the wire occurs. The operation of the air cylinder 37 is controlled by a control unit (not shown) using, e.g., a microcomputer such that the guide plate 31 is placed at the operative position only when the wire is to be inserted in the gap between the cores 3, as will be described later. Note that in addition to the above-described method of pivoting the guide plate 31 between the operative and inoperative positions, the guide plate 31 may be moved by another method, e.g., a linear drive method.

Figure 6:
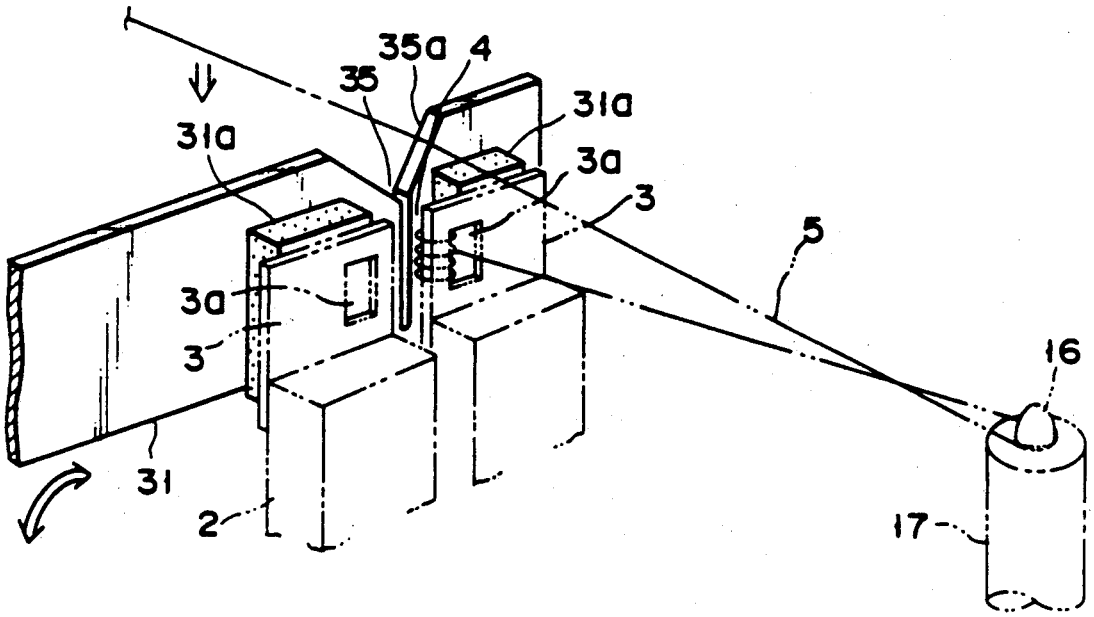
FIG. 6 is a perspective view illustrating a state wherein the guide plate is located at an operative position.
Figure 7:
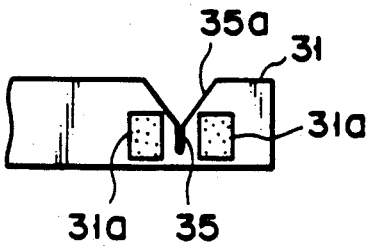
FIG. 7 is a partial front view of the guide plate.
Figure 8:
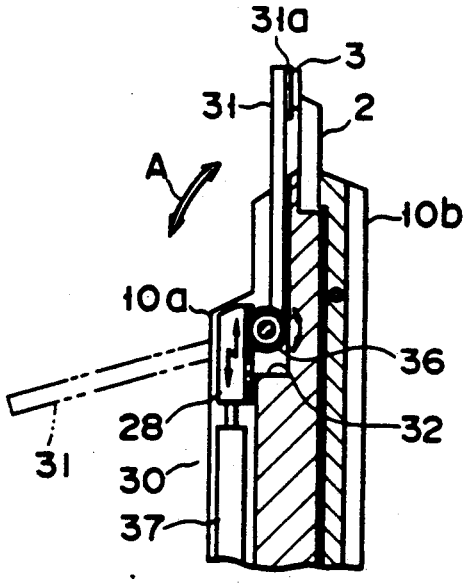
FIGS. 8 to 10 are side, front, and partially enlarged views showing a state wherein a modification of the guide plate is attached to the workpiece holder.
Figure 9:
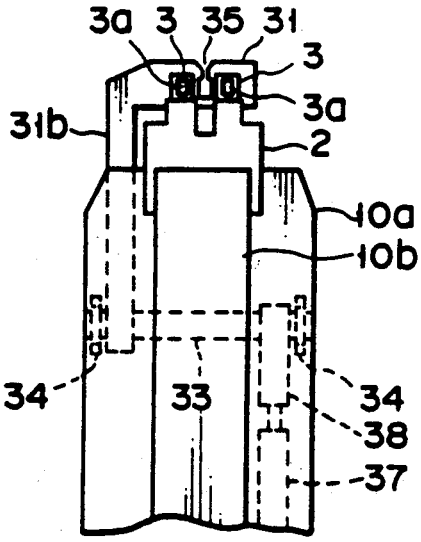

As shown in FIG. 6 and 7, the guide plate 31 includes a guide groove 35 which is matched with the gap 4 between the cores 3 of the magnetic head 2 held by the clamp members 10*a* and 10*b*. The upper portion of guide groove 35 is formed into a taper portion 35*a* which is gradually enlarged upward. When the guide plate 31 is located at the operative position shown in FIGS. 6 and 7, the wire 5 which is inserted in the gap 4 of the magnetic head 2 from the top can be easily guided. With this arrangement, when the wire 5 is to be inserted in the gap 4 from the top, peeling of the coat from the wire 5 and disconnection thereof can be prevented. Note that the side edges of the groove 35 and the taper portion 35*a* are arcuated to protect the coat of a wire.

In addition, sponge- and plate-like elastic members 31*a* each consisting of a proper resin are attached to a side surface of the guide plate 31 on the core 3 side. Each elastic member 31*a* absorbs shock acting on a corresponding core 3 when the guide plate 31 is pivoted to the operative position, and at the same time, prevents slackening of a wire already wound around the core 3.

FIGS. 8 to 12 show a modification of the guide plate 31. The same reference numerals in FIGS. 8 to 12 denote the same parts as described above, and a description thereof will be omitted.

A guide plate 31 as the modification causes a wire 5 to be wound around a core 3 within a predetermined range so as to prevent the wire 5 from being wound around the core 3 at a position near its upper or lower portion.

Figure 10:
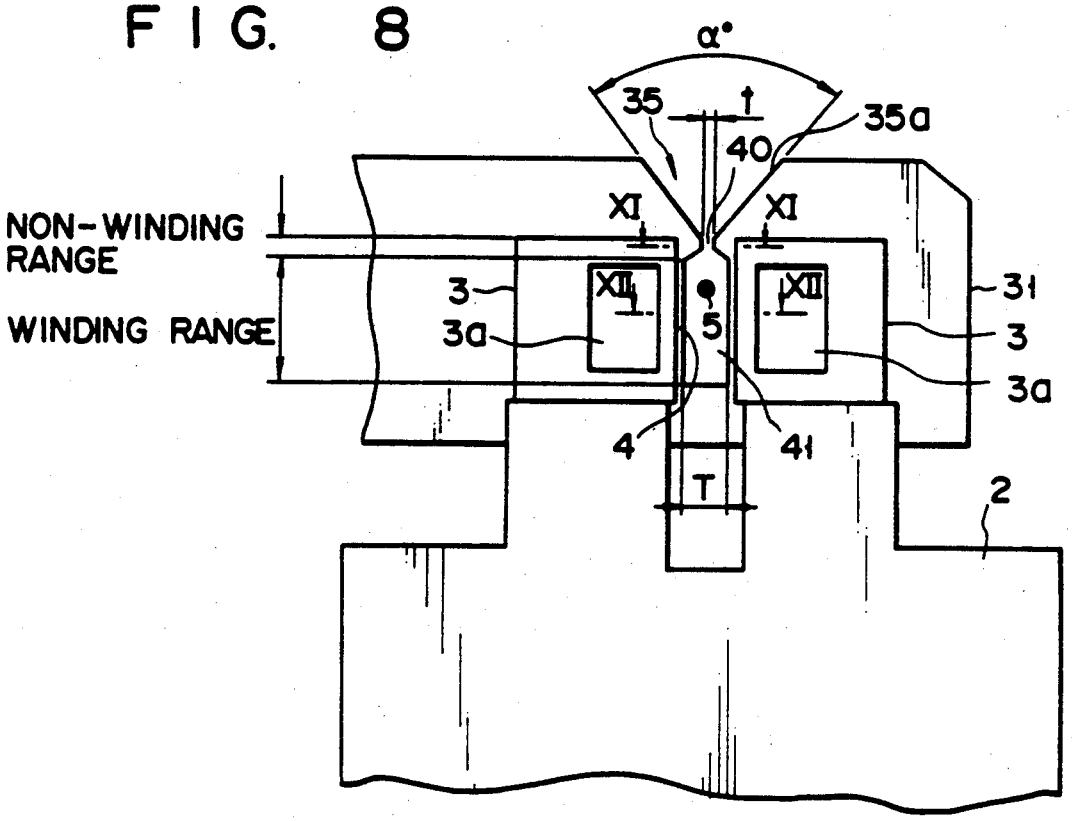
Figure 11:
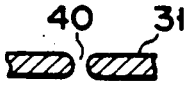
FIGS. 11 and 12 are sectional views respectively taken along lines XI—XI and XII—XII in FIG. 10.
Figure 12:
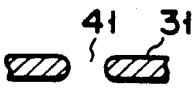

As shown by an enlarged view of FIG. 10, a guide groove 35 includes a small-width portion 40 which has a width t and is continuous with a taper portion 35*a*, and a large-width portion 41 which has a width T and defines a vertical winding range of each core 3. A portion between the small- and large-width portions 40 and 41 is formed into a smooth transitional portion. The width T of the large-width portion 41 is set to be smaller than a gap 4 between the cores 3. In addition, The side edges of the guide groove 35 are arcuated as shown in FIGS. 11 and 12 in order to prevent damage to the wire 5.

According to the guide groove 35 of the modification, a wire inserted from the taper portion 35*a* is moved from the small-width portion 40 to the large-width portion 41, and is wound around the core 3 within the range defined by the large-width portion 41, thereby preventing the core from being wound around non-winding portions close to the upper and lower end portions.

In addition, as shown in FIG. 2, the workpiece holder 8 comprises a loop guide means 53 for guiding a wire loop, which is formed when the wire engaging pin 17 is lowered, to the side opposite to the guide means 30, i.e., between the magnetic head 2 and the wire engaging pin 17. The loop guide means 53 includes upper and lower plates 54 and 55 which are opened/closed by an air cylinder 56. These plates 54, 55 are brought to the closed position after the workpiece holder 8 is rotated by 180° from the position shown in FIG. 2 to the position shown in FIG. 6 with the wire piece 5 being upwardly deflected.

Figure 13:
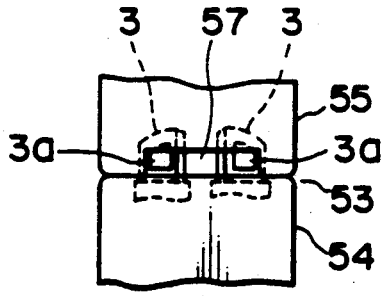
FIG. 13 is a front view illustrating a relationship between a loop guide and cores.

As shown in FIG. 13, when the upper and lower plates 54 and 55 are closed, an elongated loop guide groove 57 matching with the gap 4 between cores 3 is formed on the side opposite to the guide plate. With this arrangement, a wire loop can be reliably guided as will be described later.

Figure 14:
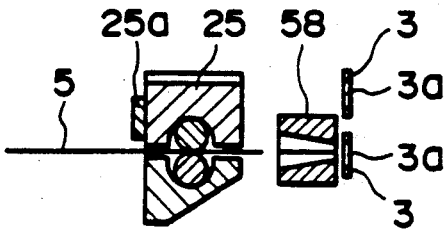
FIG. 14 is a sectional view showing a relationship between a wire feed unit and a core hole guide means.

As shown in FIG. 14, the workpiece holder 8 further comprises a core hole guide 58 for guiding the end portion of the wire 5 fed from the wire feed mechanism 25 into the core hole 3*a*. The core hole guide 58 can be constituted by guide blocks which can be vertically separated from each other by a proper actuator mechanism. When the guide 58 is closed in a state shown in FIG. 14, it guides the end portion of the wire into the core hole through a conical guide hole.

Moreover, as shown in FIG. 2, the workpiece holder 8 comprises a fixing member 59 for fixing a wire supplied from the wire supply mechanism and inserted in a core hole. The structure of this fixing member and its actuator mechanism can be arbitrarily designed as long as a wire can be fixed against a tensile force of the tension mechanism. Therefore, a detailed description thereof will be omitted.

An operation of the above-described winding apparatus will be described below.

When a wire is to be wound around a core of a magnetic head by using the above-described winding apparatus, the distal end portion of the wire supply mechanism 63 shown in FIG. 1 is lowered, and a wire is fed from the wire source. At the same time, the wire feed unit 9 opposite the mechanism 63 is moved toward the workpiece holder 8, and the wire feed mechanism 25 is removed from the wire path. Thereafter, as indicated on the right side of FIG. 2, the wire suction tube 21*a* is caused to extend through the clamp fingers 21*b* by the air cylinder so as to grip the leading end of the wire and insert it into a core hole. After the wire is extended by a predetermined length, the wire is fixed by the fixing member 59 on the wire supply mechanism side, and is then cut by the cutter 64*a* arranged in the wire supply mechanism 63. As a result, a wire piece having the predetermined length is inserted in the core hole of the magnetic head while one end of the wire is fixed by the fixing member 59 (FIG. 2) and the other end thereof is pulled by the tension mechanism to be kept taut in a desired state. With this operation, winding of the wire around the core can be performed.

Figure 15:
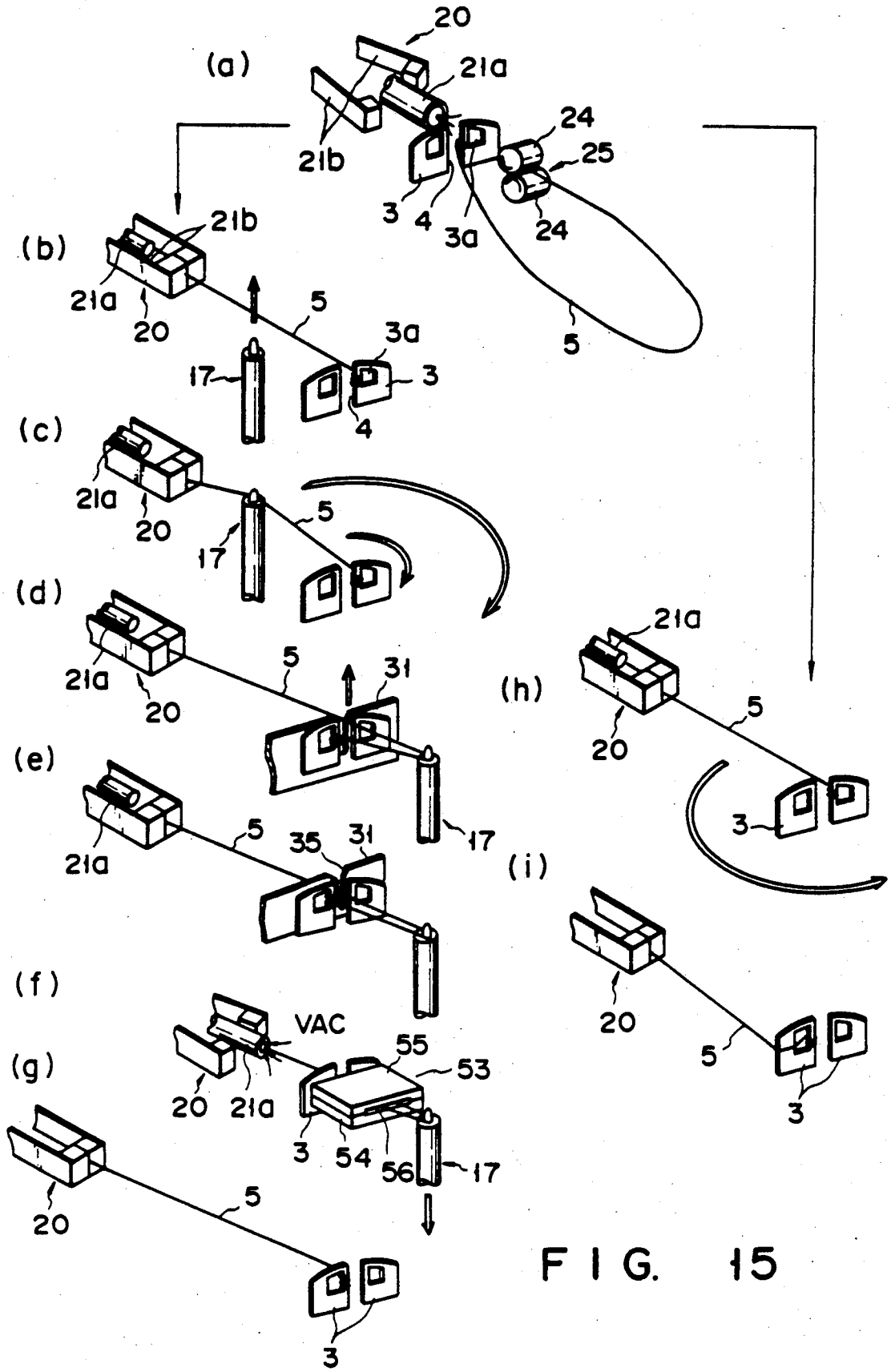
FIGS. 15(*a*) to 15(*i*) are views respectively showing steps of winding a wire around a core by using the winding apparatus shown in FIG. 1.
Figure 16:
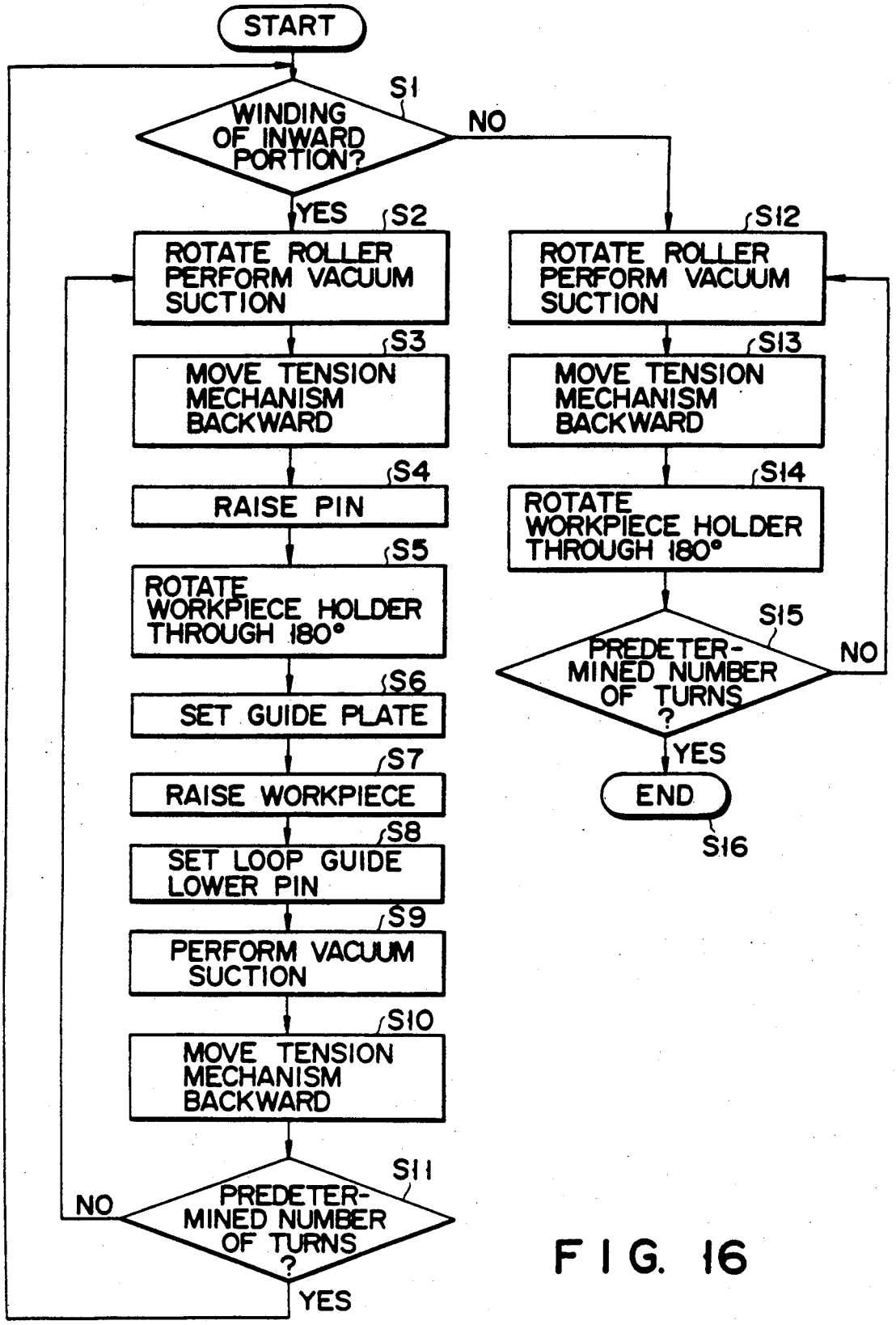
FIG. 16 is a flow chart for the winding steps in FIG. 15.

FIG. 15(*a*) shows a state wherein a wire is wound around the inward portion of the core 3 by a plurality of turns. Prior to the state shown in FIG. 15(*a*), the wire piece 5 is clamped between the pair of rollers of the wire feed mechanism while the wire piece 5 is kept taut by the tension mechanism through the gap 4, and is cut by the cutter of the wire feed mechanism at a portion on the tension mechanism side. Thereafter, the wire feed mechanism is moved toward the workpiece holder 8, and is pivoted in the direction to be set upside down. With this operation, the cut end of the wire piece is matched with the core hole and is inserted therein upon rotation of the rollers. FIG. 15(*a*) shows this state. In this case, the core hole guide 58 shown in FIG. 14 is preferably used to accurately guide the cut end of the wire piece 5, i.e., the second end or the leading end, into the core hole 3*a*.

A winding operation of the wire around the core 3 will be described in detail below with reference to FIGS. 15(*a*) to 16.

FIG. 15(*a*) shows a winding start state (step S0). When the wire piece 5 is to be wound around the inward portion of the core 3, the end portion of the wire piece 5 is fed toward the core hole 3*a* by rotating the rollers 24, and the wire suction tube 21*a* is caused to extend to perform vacuum suction (step S1). The wire suction tube 21*a* is then retracted, and the overall tension mechanism 20 is moved backward while the end portion of the wire 5 is clamped by the clamp fingers 21*b* (step S3). FIG. 15(*b*) shows this state.

Subsequently, as shown in FIG. 15(*c*), the wire engaging pin 17 is raised (step S4), and the workpiece holder 8 is rotated through 180° (step S5). In this case, since the wire piece 5 is deflected upward by the pin 17, it does not interfere with the core 3. Thereafter, as shown in FIG. 15(*d*), the guide plate 31 is located to the operative position (step S6), and the workpiece holder 8 is raised (step S7). In this case, since the wire piece 5 is guided by the guide groove 35 of the guide plate 31, damage to the wire piece 5 can be prevented.

The loop guide means 53 is then set between the cores 3 and the pin 17 as shown in FIG. 15(*f*), and the pin 17 is lowered while the wire suction tube 21*a* extended to receive the wire piece 5 (steps S8 and S9). Subsequently, the tension mechanism 20 is moved backward (step S10). In this case, since a loop of the wire piece 5 formed by removing the pin 17 from the wire piece 5 is guided by the guide hole 56 of the loop guide 53, entanglement with other members or of the wire piece 5 itself can be prevented. FIG. 15(*g*) shows a state wherein the tension mechanism 20 is moved backward, and the wire is wound around the inward portion of the core 3 by one turn.

It is checked whether the wire is wound around the inward portion of the core 3 by a predetermined number of turns (step S11). If NO is obtained in this step, the above-described step corresponding the state set by the wire feed mechanism 25 shown in FIG. 15(*a*) is repeated (step S2). If the number of turns of the inward portion of the core 3 reaches the predetermined number, winding of the outward portion is started (step S1).

When the wire piece 5 is to be wound around the outward portion, the rollers 24 are rotated while vacuum suction is performed from the side opposing the rollers 24 in the same manner as described in step S2 from the state shown in FIG. 15(*a*), and the tension mechanism 20 is moved backward (steps S12 and S13). Thereafter, as shown in FIG. 15(*f*), the workpiece holder 8 is rotated through 180° in the direction opposite to that described above (step S14). As a result, the wire is wound around the outward portion of the core 3, as shown in FIG. 15(*i*). After the number of turns reaches a predetermined number by repeating these steps, winding of the wire piece 5 around the one of cores 3 is completed (steps S15 and S16).

A winding apparatus according to a second embodiment will be described below with reference to FIGS. 17 to 35. Since this winding apparatus is substantially the same as that of the first embodiment, the same reference numerals in the second embodiment denote the same parts as in the first embodiment, and a description thereof will be omitted.

Figure 17:
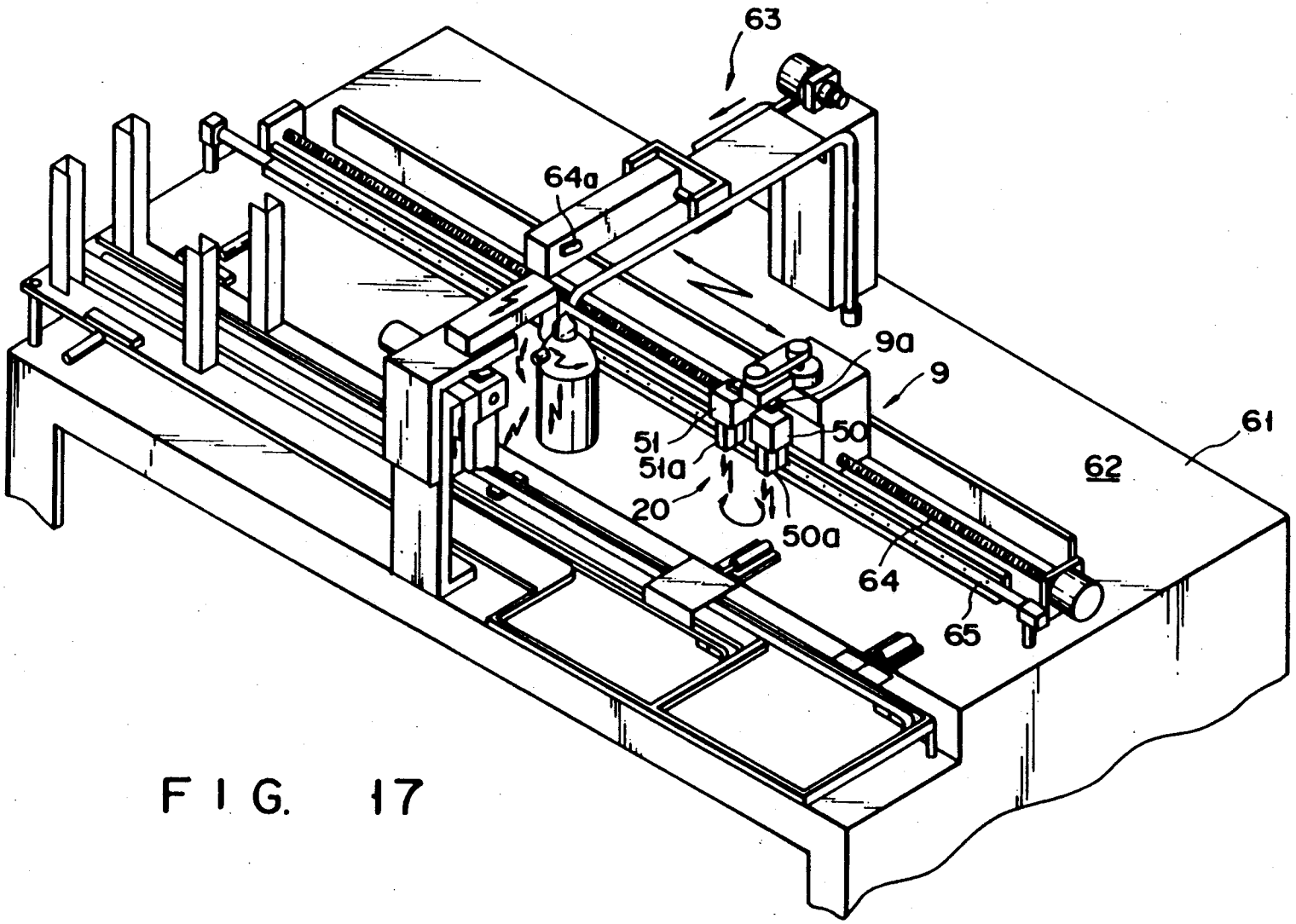
FIG. 17 is a perspective view illustrating an overall structure of a winding apparatus according to another embodiment of the present invention.

As shown in FIG. 17, a winding apparatus 60 comprises only one wire inserting unit 9 as the tension mechanism 20. The wire inserting unit 9 comprises an arm member 9*a* and wire clamp members, i.e., chucks 50 and 51 attached to both the ends of the arm member 9*a*. The arm member 9*a* can be rotated about a vertical axis located at the center thereof. The chucks 50 and 51 can be vertically moved. A wire can be alternately clamped by two pairs of clamp jaw members 50*a* and 51*a* of the chucks 50 and 51. Any proper actuator mechanism for these members can be employed.

A wire is wound around a core of a magnetic head by this winding apparatus in a manner shown in FIGS. 18A to 31. Of these drawings, one to which the letter A is suffixed is a side view, and one to which the letter B is suffixed is a plan view.

Figure 18A:
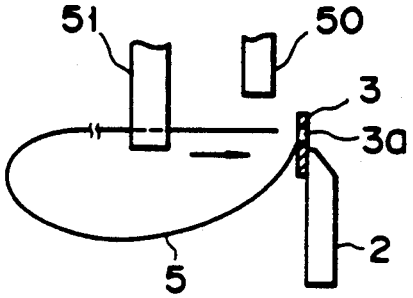
Figure 18B:
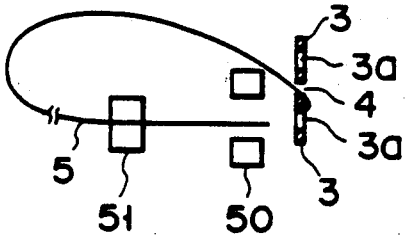

As shown in FIGS. 18A and 18B, insertion of a wire piece 5 is started by the chuck 51 located farther from a magnetic head 2 than the chuck 50. This state corresponds to the step shown in FIG. 15(*a*) of the steps performed by the winding apparatus of the first embodiment.

When insertion of the wire piece 5 is to be performed, the wire piece 5 is clamped by the left and lowered chuck 51 of the pair of chucks 50 and 51 which can be moved forward/backward with respect to the magnetic head 2, and the chuck 51 is moved close to the core 3 of the magnetic head 2 together with the chuck 50. With this operation, the leading end of the clamped wire piece 5 is inserted into a core hole 3*a*.

Figure 21A:
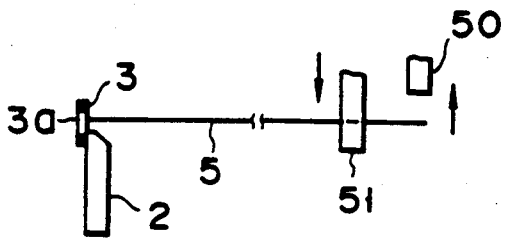
Figure 21B:
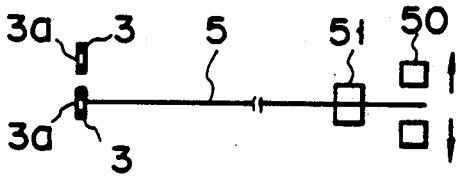
Figure 22:
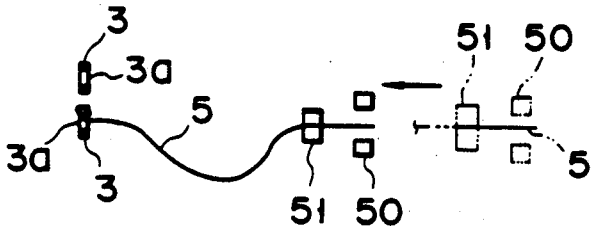
Figure 23:
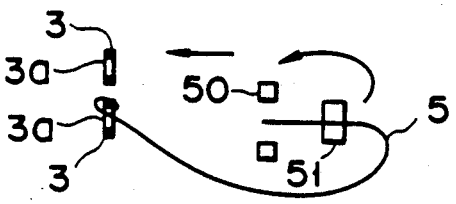
Figure 19A:
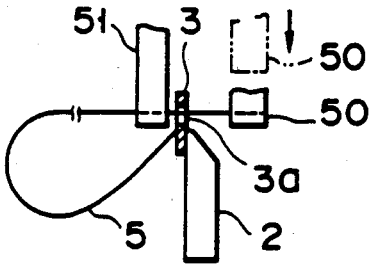
Figure 19B:
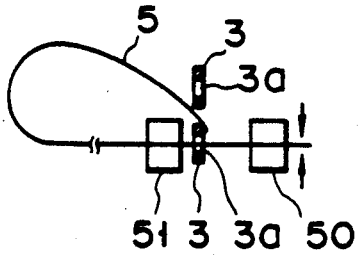
Figure 20A:
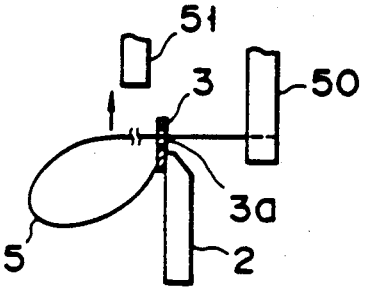
Figure 20B:
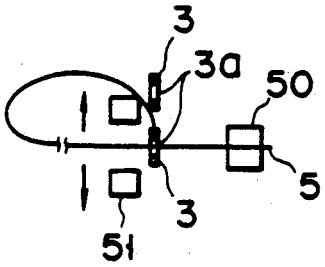

When the leading end of the wire piece 5 is inserted in the core hole 3*a*, the chuck 50 which has been kept ready on an upper right side of the magnetic head 2 with its clamp jaws being kept open is lowered to clamp the leading end of the wire piece 5, as shown in FIGS. 19A and 19B. Subsequently, as shown in FIGS. 20A and 20B, the chuck 51 is moved upward, and the chuck 50 is moved away from the magnetic head 2 together with the chuck 51. As a result, the wire piece 5 is drawn from the core 3. Thereafter, as shown in FIGS. 21A and 21B, the chuck 51 which has been kept ready in the upper position is lowered to clamp the wire piece 5, and the chuck 50 is moved upward with its clamp jaws being kept open. After the leading end of the wire piece 5 regripped from the chuck 50 to the chuck 51, the chucks 50 and 51 are rotated in the opposite directions, thereby starting a wire piece reverse rotation step;

In the wire piece reverse rotation step, the wire piece is regripped as indicated by phantom lines in FIG. 22, the chucks 50 and 51 are moved toward the magnetic head 2. When the wire piece 5 is slacked to such an extent that entanglement of the wire piece 51 with the chuck 51 does not occur as shown in FIG. 23, the chucks 50 and 51 are rotated through 180° and are moved close to the magnetic head 2 in this state.

Figure 24A:
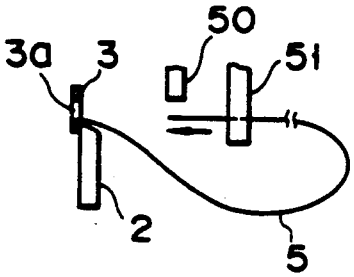
FIGS. 18 to 29 are views each sequentially showing steps of winding a wire around a core by using the winding apparatus shown in FIG. 17.
Figure 24B:
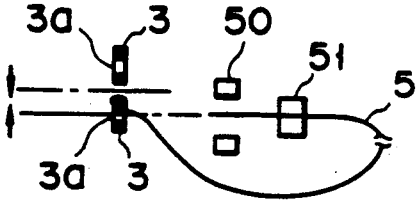
Figure 25A:
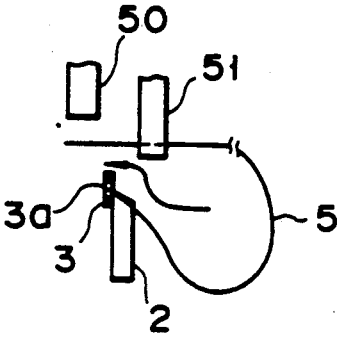
Figure 25B:
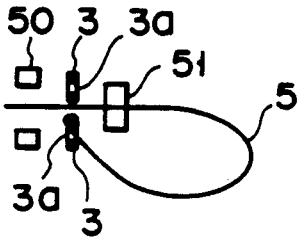

Subsequently, as shown in FIGS. 24A and 24B, when the leading end of the wire piece 5 is moved close to the magnetic head 2, the chucks 50 and 51 are raised to an upper region where interruption with the magnetic head 2 does not occur, and at the same time, the chucks 50 and 51 are laterally moved so as to cause the leading end of the wire piece 5 to coincide with the center of the gap 4. Instead of this operation, the magnetic head 2 may be moved with respect to the chucks.

Figure 26:
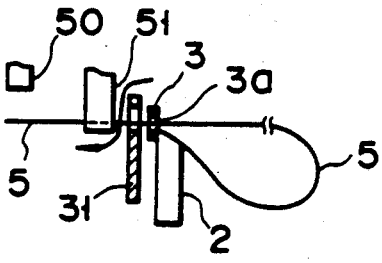
Figure 27:
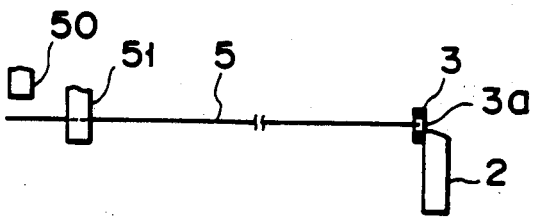
Figure 32:
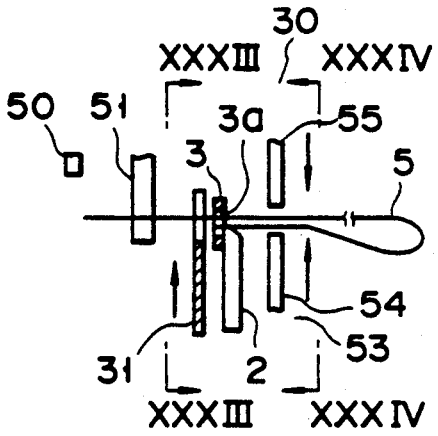
FIG. 32 is a view showing a state wherein a wire is guided by the guide plate and the loop guide.
Figure 33:
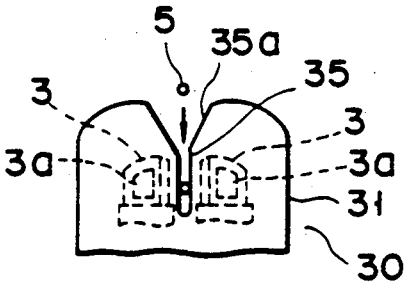
FIG. 33 is a sectional view taken along a line XXXIII—XXXIII in FIG. 32, illustrating a relationship between the guide plate and the wire.
Figure 34:
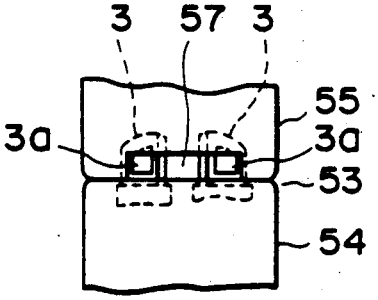
FIG. 34 is a sectional view taken along a line XXXIV—XXXIV in FIG. 32, illustrating a relationship between the loop guide and the core.
Figure 35:
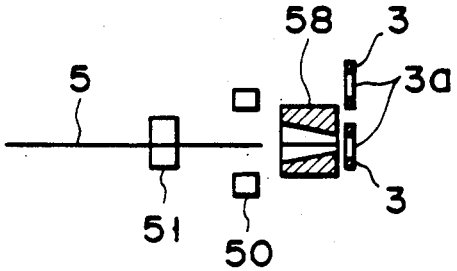
FIG. 35 is a view showing a relationship between a core hole guide and cores.

When the chucks 50 and 51 cross over the magnetic head 2 as shown in FIG. 26, they are lowered to the home positions, respectively. When the chucks 50 and 51 are then moved away from the magnetic head 2, the wire piece 5 is guided by a guide plate 31 and is inserted in the gap 4. In this case, as shown in FIGS. 32 to 34, since the wire piece 5 is guided by the guide plate 31 and a loop guide 53 which are similar to those in the first embodiment, damage can be prevented. FIG. 27 shows a state wherein the wire piece wound around the inward portions of the core is kept taut. Subsequently, the above-described steps are repeated so that the wire can be wound around the inward portion of the core by a predetermined number of turns.

Figure 28:
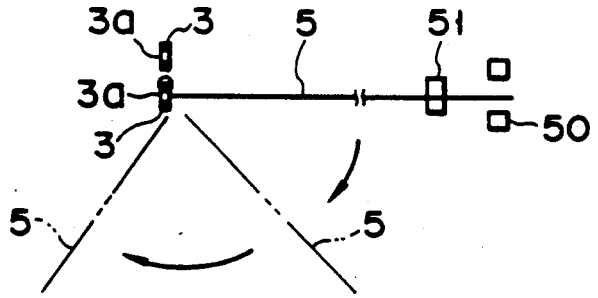
Figure 29:
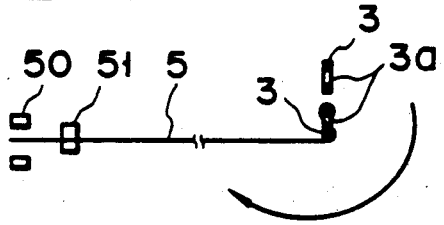

When the chucks 50 and 51 are rotated through 180° about the magnetic head 2 as shown in FIG. 28 after winding of the inward portion of the core 3 is completed, the wire piece 5 is wound around the outward portion of the core 3 as shown in FIG. 29. The leading end of the wire piece 5 is then reversed (FIGS. 22 and 23) to be inserted in the core hole 3*a*. If a core guide 57 is disposed, the leading end of the wire piece 5 can be reliably inserted in the core hole 3*a*. By repeating these steps, the wire can be wound around the outward portion of the core by a predetermined number of turns.

Figure 30:
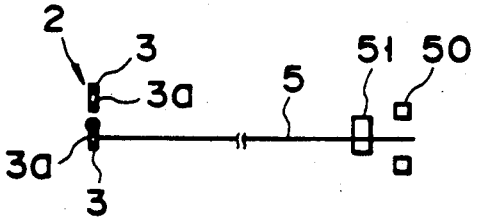
FIGS. 30 and 31 are views each showing a step as a modification of a corresponding step shown in FIGS. 18 to 29.
Figure 31:
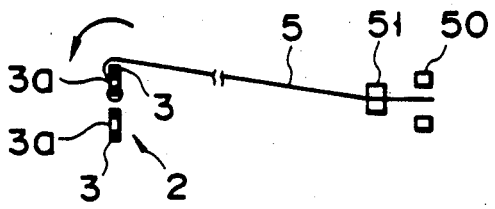

When a wire is to be wound around the outward portion of a core, the workpiece holder may be rotated to rotate the magnetic head 2 as shown in FIGS. 30 and 31 instead of rotating the chucks as shown in FIGS. 28 and 29.

The embodiments of the present invention have been described above. However, the present invention is not limited to the above-described embodiments. Various changes and modifications can be made within the spirit and scope of the invention.

What is claimed is:

1. An apparatus for winding a wire piece having first and second end portions by at least one turn around at least one of a plurality of frame-like cores which are laterally formed on a workpiece with a small gap set therebetween and each of which has first and second end faces, the wire piece being inserted in the frame-like core, comprising:

a base having an operation surface;

workpiece holding means, mounted on said base so as to be rotatable about an axis perpendicular to said operation surface, for holding the workpiece with the frame-like core extending therefrom, the wire piece having the first end portion fixed to said means on the first end face side and the second end portion extending toward the second end face being inserted in the core held by said means;

first tension means, mounted on said operation surface so as to be movable in directions to move close and away from said workpiece holding means, for holding the second end portion of the wire piece and keeping the wire piece taut;

wire deflecting means which is fixed to said workpiece holding means on the second end face side of the core so as to be movable between an inoperative position at which said wire deflecting means is not brought into contact with the wire piece and an operative position at which the wire piece is deflected to one side, the operative position being defined such that contact of a portion of the wire piece between said workpiece holding means and said first tension means with the frame-like core is prevented when said workpiece holding means is rotated about the rotational axis thereof; and guide means for guiding a wire piece portion between said first tension means and said wire deflecting means when said wire deflecting means returns to the inoperative position after said wire deflecting means is rotated together with said workpiece holding means to a position at which each face of the frame-like core is reversely located, said guide means having a guide plate which has a guide groove matching with the gap between the adjacent cores when said guide plate is in the operative position, the wire piece passing through said guide groove so as to be positioned in the gap between the adjacent cores.

2. An apparatus according to claim 1, wherein said guide plate is attached to said workpiece holding means on the first end face side of the frame-like core so as to be movable between an inoperative position at which said guide plate does not interfere with the wire piece when said workpiece holding means is rotated and an operative position to guide the wire piece when said wire deflecting means returns to the inoperative position.

3. An apparatus according to claim 2, wherein said guide groove includes a fan-like inlet portion enlarging outward and has each edge portion of an arcuated section so as to prevent damage to the wire piece.

4. An apparatus according to claim 3, wherein said guide groove includes a small-width portion continuous with said inlet portion and a large-width portion continuous with said small-width portion on a side opposite to said inlet portion, said large-width portion defining a winding range of the frame-like core.

5. An apparatus according to claim 3, further comprising first wire feed means, mounted on said operation surface so as to be movable in directions to move close to and away from said workpiece holding means and a wire portion between said first tension means and said frame-like core, for clamping a second end portion side of the wire piece after said wire deflecting means returns to the inoperative position and feeding the second end portion of the wire piece toward the frame-like core.

6. An apparatus according to claim 5, further comprising loop guide means, attached to said workpiece holding means on a second end face side of the frame-like core, for preventing a loop formed by a wire piece portion on the second end face side from being caught by the workpiece when the wire piece is kept taut by said first tension means through the second end portion after said wire deflecting means returns to the inoperative position.

7. An apparatus according to claim 6, wherein said loop guide means is constituted by two plate members which are arranged within substantially the same plane and are movable between an operative position at which said plate members are brought into contact with each other and an inoperative position at which said plates are separated from each other, said plate members forming an opening through which the loop of the wire piece is inserted at the operative position.

8. An apparatus according to claim 6, further comprising second tension means, mounted on said operation surface on a side opposite to said first tension means so as to be movable in directions to move close to and away from said workpiece holding means, for receiving the second end portion of the wire piece inserted by said first wire feed means through a core hole of the frame-like core and keeping the wire piece taut, and a second wire feed means, mounted on said operation surface on a side opposite to said first wire feed means so as to be movable in directions to move close to and away from said workpiece holding means and a wire piece portion between said first tension means and the frame-like core, for clamping the second end portion of the wire piece and feeding the second end portion of he wire piece toward the frame-like core.

9. An apparatus according to claim 8, further comprising core hole guide means for guiding the second end portion of the wire piece fed from said second feed means into the core hole.

10. An apparatus according to claim 9, wherein said core hole guide means includes two guide blocks which are separated from each other along an axis parallel to a feed direction of the second end portion of the wire piece and are movable between an operative position at which said guide blocks are brought into contact with each other and an inoperative position at which said guide blocks are separated from each other, said guide blocks including a guide hole tapered toward a core hole direction at the operative position.

11. An apparatus for winding a wire piece having first and second end portions by at least one turn around at least one of a plurality of frame-like cores which are laterally formed on a workpiece with a small gap set therebetween and each of which has first and second end faces, the wire piece being inserted in the frame-like core, comprising:

a base having an operation surface;

workpiece holding means, mounted on said base so as to be rotated about an axis perpendicular to said operation surface, for holding the workpiece with the frame-like core extending therefrom, the wire piece having the first end portion fixed to said means on the first end face side and the second end portion extending toward the second end face side and the second end portion extending toward the second end face being inserted in the core held by said means;

tension means, mounted on said operation surface so as to be movable in directions to move close and away from said workpiece holding means, for holding the second end portion of the wire piece, said tension means including at least one wire clamp member which can be rotated about an axis perpendicular to said operation surface and can be moved between a first position close to said operation surface and a second position spaced apart therefrom; and guide means for guiding a wire piece portion when said clamp member returns to the first position after the second end portion of the wire piece is located on the first end face side of the frame-like core by performing one of an operation for rotating said workpiece holding means and an operation for moving said tension means across said workpiece holding means, while said clamp member clamps the second end portion of the wire piece and is located to the second position, said guide means having a guide plate which has a guide groove matching with the gap between the adjacent cores when said guide plate is in the operative position, the wire piece passing through said guide groove so as to be positioned in the gap between the adjacent cores.

12. An apparatus according to claim 11, wherein said guide plate is attached to said workpiece holding means on the first end face side of the frame-like core so as to be movable between an inoperative position at which said guide plate does not interfere with the wire piece when the second end portion side of the wire piece is moved to the first end face side of the frame-like core and an operative position to guide the wire piece when said wire deflecting means returns to the inoperative position.

13. An apparatus according to claim 12, wherein said guide groove includes a fan-like inlet portion enlarging outward and has each edge portion of an arcuated section so as to prevent damage to the wire piece.

14. An apparatus according to claim 13, wherein said guide groove includes a small-width portion continuous with said inlet portion and a large-width portion continuous with said small-width portion on a side opposite to said inlet portion, said large-width portion defining a winding range of the frame-like core.

15. An apparatus according to claim 14, further comprising loop guide means, attached to said workpiece holding means on a second end face side of the frame-like core, for preventing a loop formed by a wire piece portion on the second end face side from being caught by the workpiece when the wire piece is kept taut by said tension means after said clamp member clamping the second end portion of the wire piece returns to the first position.

16. An apparatus according to claim 15, wherein said loop guide means is constituted by two plate members which are arranged within substantially the same plane and are movable between an operative position at which said plate members are brought into contact with each other and an inoperative position at which said plates are separated from each other, said plate members forming an opening through which the loop of the wire piece is inserted at the operative position.

17. An apparatus according to claim 16, wherein said tension means comprises an arm member having first and second end portions and rotational axis extending therebetween and perpendicular to said operation surface, and two clamp members respectively attached to said first and second end portions, said two clamp members being able to alternately clamp the wire piece.

18. An apparatus according to claim 17, further comprising core hole guide means for guiding the second end portion of the wire piece to the core hole of the frame-like core when one of said clamp members located on a side farther from said workpiece holding means than the other clamp member holds the second end portion of the wire piece and is moved toward said workpiece holding means.

19. An apparatus according to claim 18, wherein said core hole guide means includes two guide blocks which are separated from each other along an axis parallel to a feed direction of the second end portion of the wire piece and are movable between an operative position at which said guide blocks are brought into contact with each other and an inoperative position at which said guide blocks are separated from each other, said guide blocks including a guide hole tapered toward a core hole direction at the operative position.

* * * * *